US010112406B2

(12) United States Patent
Ando et al.

(10) Patent No.: US 10,112,406 B2
(45) Date of Patent: Oct. 30, 2018

(54) GEAR PUMP AND PRINTING APPARATUS PROVIDED WITH SAME

(71) Applicant: SEIKO EPSON CORPORATION, Tokyo (JP)

(72) Inventors: Masaaki Ando, Nagano (JP); Noritaka Mitsuo, Nagano (JP); Norihiro Maruyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/671,496

(22) Filed: Aug. 8, 2017

(65) Prior Publication Data

US 2017/0334212 A1 Nov. 23, 2017

Related U.S. Application Data

(63) Continuation of application No. 15/095,250, filed on Apr. 11, 2016, now Pat. No. 9,751,321.

(30) Foreign Application Priority Data

Apr. 17, 2015 (JP) ..... 2015-084841

(51) Int. Cl.

| | |
|---|---|
| ***B41J 2/175*** | (2006.01) |
| ***F04C 2/08*** | (2006.01) |
| ***F01C 21/02*** | (2006.01) |
| ***F01C 21/10*** | (2006.01) |
| ***F04C 2/14*** | (2006.01) |

(Continued)

(52) U.S. Cl.

CPC ..... *B41J 2/17596* (2013.01); *F01C 21/02* (2013.01); *F01C 21/10* (2013.01); *F04C 2/086* (2013.01); *F04C 2/14* (2013.01); *F04C 13/001* (2013.01); *F04C 15/06* (2013.01); *F04C 2210/205* (2013.01); *F04C 2240/60* (2013.01); *F04C 2270/17* (2013.01)

(58) Field of Classification Search

CPC ..... B41J 2/17596; F04C 2/14; F04C 2/086; F04C 21/02; F04C 21/10; F04C 13/001; F04C 2210/205; F04C 2240/60; F04C 2270/17; F04C 15/06

USPC ..... 347/85

See application file for complete search history.

(56) References Cited

U.S. PATENT DOCUMENTS 4,792,292 A * 12/1988 Gaenzle ..... B41J 2/17596 101/366

6,523,944 B1 * 2/2003 Roy ..... B41J 2/14008 347/85

2006/0142414 A1 6/2006 Hudd et al.

(Continued)

FOREIGN PATENT DOCUMENTS

JP 2012-021516 A 2/2012

*Primary Examiner* — Huan Tran
*Assistant Examiner* — Alexander D Shenderov

(57) ABSTRACT

A gear pump includes a pump casing and a gear assembly. The gear assembly includes a driving gear, a driven gear, a driving gear shaft, a driven gear shaft, and a bearing frame. The bearing frame includes a frame main body, a pair of driving side bearing portions, and a pair of driven side bearing portions. The frame main body has a pair of bearing support portions, in which the driving side bearing portion and the driven side bearing portion are provided, and a connecting portion which connects the bearing support portions. The bearing support portions and the connecting portion are integrated together as a one-piece member.

15 Claims, 5 Drawing Sheets

(51) Int. Cl.
*F04C 13/00* (2006.01)
*F04C 15/06* (2006.01)

(56) References Cited

U.S. PATENT DOCUMENTS

2008/0240968 A1* 10/2008 Chiu ..... F04C 2/086
418/206.7
2011/0148957 A1* 6/2011 Park ..... B41J 2/17509
347/6

* cited by examiner

GEAR PUMP AND PRINTING APPARATUS PROVIDED WITH SAME

CROSS-REFERENCE TO RELATED APPLICATIONS

This is a continuation application of U.S. patent application Ser. No. 15/095,250, which claims priority to Japanese Patent Application No. 2015-084841 filed on Apr. 17, 2015. The entire disclosures of U.S. patent application Ser. No. 15/095,250 and Japanese Patent Application No. 2015-084841 are hereby incorporated herein by reference.

BACKGROUND

1. Technical Field

The present invention relates to a gear pump in which a driving gear and a driven gear that exhibit a pumping action are accommodated in a pump casing and a printing apparatus provided with the same.

2. Related Art

In the related art, a gear pump that transports an ultraviolet-curable ink is known as this type of gear pump (refer to JP-A-2012-21516).

The gear pump is provided with a drive shaft that inputs the power from a motor via a power transmission mechanism, a driving gear attached to the drive shaft, a driven gear that meshes with the driving gear, and a fixed shaft that rotatably supports the driven gear. The gear pump is provided with a case (pump chamber) that has a suction port and a discharge port, and that accommodates the driving gear and the driven gear along with the drive shaft and the fixed shaft.

Meanwhile, a controller that controls the motor alternately executes reverse driving and forward driving of the motor a plurality of times whenever a threshold time elapses after the motor starts forward driving. The driving and driven gears are helical gears and reverse driving and forward driving are alternately performed so that the thrust force alternately works in the forward and reverse directions and the drive shaft and the driven gear move slightly, as appropriate, in the axial direction. In so doing, ink that lubricates between the driving gear and a first bearing portion that supports the driving gear and ink that lubricates between the driven gear and the fixed shaft that supports the driven gear flow. Although the ultraviolet-curable ink undergoes a polymerization reaction and is cured induced by heat or the like, the curing of the ink is suppressed by the flow, and fixing of the drive shaft and driven gear is prevented.

In the gear pump of the related art, a problem arises in that not only does the control of the motor become complicated, but also the transport of the ultraviolet-curable ink that is the original function becomes unstable due to the forward and reverse driving.

The relationship between the drive shaft and the first bearing portion and the relationship between the driven gear and the fixed shaft are included in the relationship between the shaft and the bearing in a relative sense. Therefore, as long as the clearance between the shaft and the bearing is formed with high accuracy, it is thought that friction at those parts is reduced (an ultraviolet-curable ink properly functions as a lubricant (lubricating oil)), excess heat generation is suppressed, and curing of the ultraviolet-curable ink is prevented.

However, in the gear pump of the related art, since a bearing part which supports a driving shaft and a fixing shaft at both ends thereof is formed in a case (pump casing), there is a problem in that it is difficult to form the gear pump with high accuracy. That is, in a pair of bearing parts which supports each shaft, it is necessary to form the bearing parts so that each of axis lines thereof coincides with each other, and in pairs of adjacent bearing parts, it is necessary to form the bearing parts so that the axis lines are parallel with each other. In such cases, in a case (pump casing) which requires a divided structure, it is particularly difficult to form a total of four bearing parts mutually with high accuracy. Therefore, the shaft with respect to the bearing part is easily supported in an inclined manner. Since a rotating shaft is directly contacted with the bearing part, frictional heat is generated.

SUMMARY

An advantage of some aspects of the invention is to provide a gear pump that is able to form a bearing part which supports a driving gear shaft and a bearing part which supports a driven gear shaft respectively with high accuracy and form the bearing parts mutually with high accuracy and a printing apparatus provided with the same.

According to an aspect of the invention, there is provided a gear pump for transporting a fluid including a pump casing; and a gear assembly which is accommodated in the pump casing. The gear assembly includes a driving gear, a driven gear that meshes with the driving gear, a driving gear shaft to which the driving gear is attached, a driven gear shaft to which the driven gear is attached, and a bearing frame that rotatably supports the driving gear shaft and rotatably supports the driven gear shaft. The bearing frame includes a frame main body, a pair of driving side bearing portions which is provided in the frame main body and which supports the driving gear shaft, and a pair of driven side bearing portions which is provided in the frame main body and which supports the driven gear shaft. The frame main body has a pair of bearing support portions, in which the driving side bearing portion and the driven side bearing portion are provided, and a connecting portion which connects the bearing support portions. The bearing support portions and the connecting portion are integrated together as a one-piece member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, the gear pump and printing apparatus to which the gear pump is mounted according to an embodiment of the invention will be described with reference to the attached drawings. The printing apparatus performs printing by feeding a set printing medium in a roll-to-roll format, and discharging an ultraviolet-curable ink (below, referred to as a "UV ink") to the printing medium being fed with an ink jet method. The gear pump is incorporated into the ink supply system of the printing apparatus as a circulation pump.

Structure of Printing Apparatus

Figure 1:
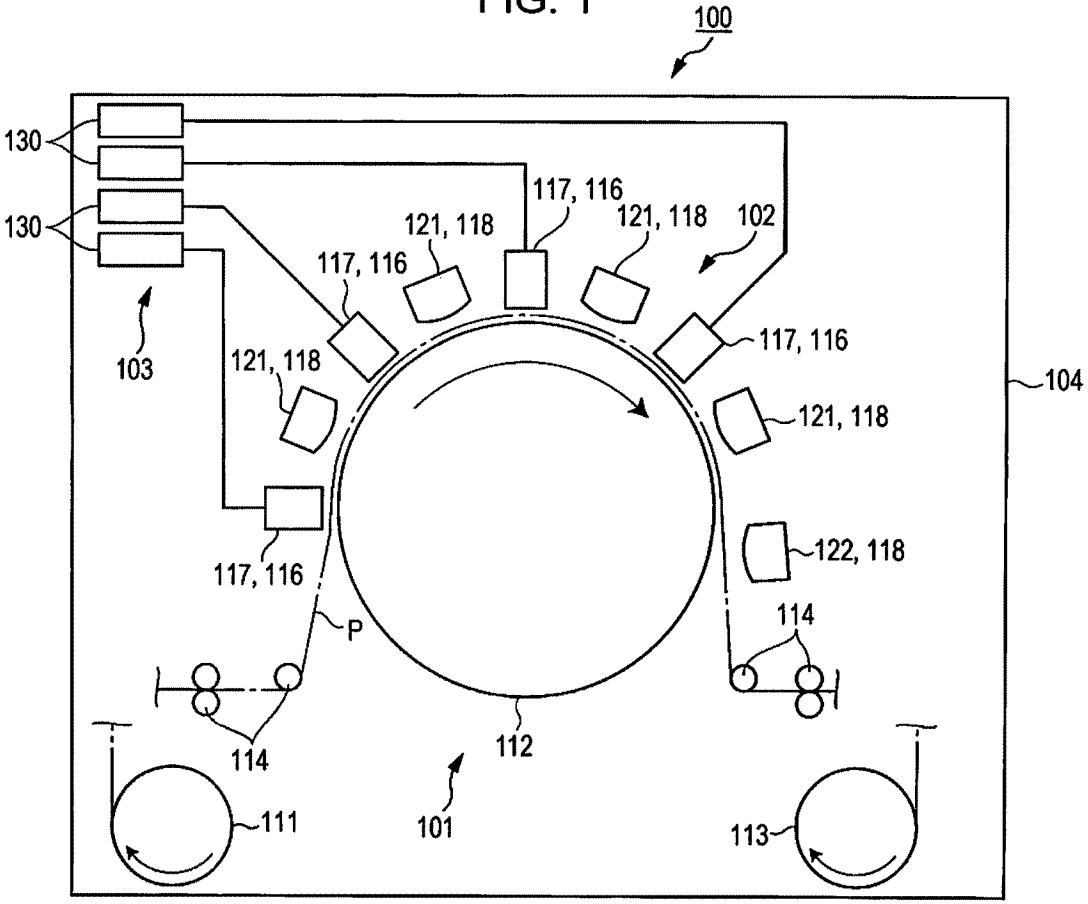
FIG. 1 is an explanatory diagram schematically illustrating a structure of a printing apparatus according to an embodiment.

FIG. 1 is an explanatory diagram schematically illustrating the structure of the printing apparatus according to the embodiment. As shown in the drawing, the printing apparatus 100 is provided with a medium feed unit 101 that feeds a sheet-like printing medium P in a roll-to-roll format, a printing unit 102 that performs printing on the printing medium P being fed using the UV ink, an ink supply mechanism 103 that supplies the UV ink to the printing unit 102, and an apparatus cover 104 that accommodates these internal devices. The material of the printing medium P is not particularly limited, and various printing media such as paper or film-based media are used.

The medium feed unit 101 is provided with a delivery reel 111 that delivers the printing medium P that is wound in a roll shape, a rotary drum 112 that performs feeding while holding the delivered printing medium P in order to perform printing, a winding reel 113 that winds up the printing medium P fed out from the rotary drum 112 into a roll shape, and a plurality of rollers 114 that regulate (path modification) the feed path of the printing medium with the rotary drum 112 as a center.

The printing medium P is fed so as to be held by frictional force to the outer circumferential surface of the rotary drum 112, and to move around by rotation of the rotary drum 112. The printing unit 102 is opposite a portion of the outer circumferential surface of the rotary drum 112, and discharges (prints) the UV ink onto the printing medium P being sent out based on the printing data. That is, the rotary drum 112 serves as a platen in the printing unit 102.

The printing unit 102 includes a plurality of head units 117, and is provided with an ink discharge unit 116 that discharges the UV ink onto the printing medium P, and a radiation unit 118 that causes the UV ink with which the printing medium P is coated to be cured through radiation of ultraviolet rays.

The plurality of head units 117 are provided lined up along the outer circumferential surface of the rotary drum 112. The plurality of head units 117 have a one-to-one correspondence to a plurality of types (for example, the four colors of C-M-Y-K) of UV inks. Each color of head unit 117 is provided with a plurality of ink jet heads 120 (refer to FIG. 2) to form one printing line in the axial direction of the rotary drum 112. The plurality of ink jet heads 120 of each head unit 117 selectively discharge the UV ink with respect to the printing medium P supported on the outer circumferential surface of the rotary drum 112. In so doing, a color image is formed on the printing medium P.

The radiation unit 118 is provided with a plurality of preliminary curing radiation devices 121 corresponding to the plurality of head units 117, and a main curing radiation device 122 inserted in the feed path between the rotary drum 112 and the winding reel 113. The plurality of preliminary curing radiation devices 121 are arranged so as to be alternately lined up one by one with the plurality of head units 117 along the outer circumferential surface of the rotary drum 112. In this case, the preliminary curing radiation devices 121 are arranged on the downstream side in the feed direction of the printing medium P with respect to the corresponding head unit 117. When the UV ink is discharged on to the printing medium P, the UV ink is irradiated with ultraviolet rays directly after landing on the printing medium P, and preliminary curing is performed. In so doing, spreading of the dots of UV inks and mixing of the colors are suppressed.

The main curing radiation device 122 is arranged further toward the downstream side than the preliminary curing radiation device 121 provided on the most downstream portion of the feed path. The main curing radiation device 122 radiates a greater accumulated amount of ultraviolet rays than the preliminary curing radiation device 121 with respect to the printing medium P on which discharge of the UV ink and preliminary curing are performed. In so doing, the UV ink deposited on the printing medium P is completely cured and is fixed to the printing medium P. It is possible for a light emitting diode (LED) lamp, a high pressure mercury lamp, or the like that radiates ultraviolet rays to be used in the preliminary curing radiation device 121 and the main curing radiation device 122.

Configuration of Ink Supply System

The ink supply mechanism 103 is a mechanism that supplies UV ink to each ink jet head 120 (print head), and includes a plurality (by ink color) of ink supply systems 130 with respect to the plurality of types of UV ink.

Figure 2:
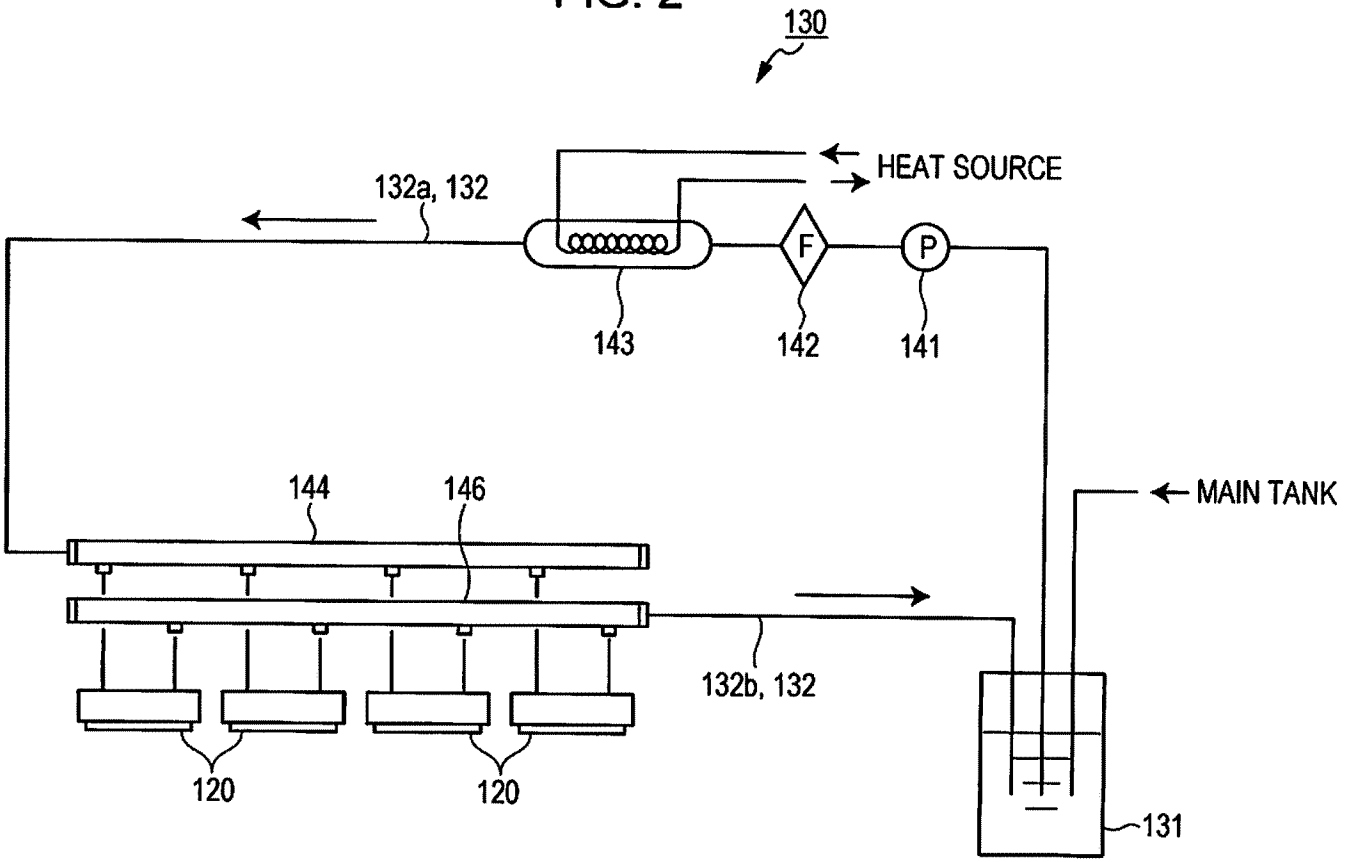
FIG. 2 is a system diagram of an ink supply system in the printing apparatus.

As shown in FIG. 2, each ink supply system 130 is provided with a sub-tank 131 connected to a main tank, not shown, and a circulation flow path 132 that connects the sub-tank 131 and the plurality of ink jet heads 120. In the sub-tank 131, the UV ink is replenished from the main tank and the liquid level in the sub-tank 131 is held constant. The sub-tank 131 is arranged at a height at which the water head difference between the liquid level of the sub-tank 131 and the nozzle surface of the ink jet head 120 becomes a predetermined value. In so doing, the UV ink is supplied to each ink jet head 120 at a predetermined water head pressure.

The circulation flow path 132 includes an outward flow path 132*a* that leads to the plurality of ink jet heads 120 from the sub-tank 131, and a return flow path 132*b* that leads to the sub-tank 131 from the plurality of ink jet heads 120. A heat exchanger 143 and an outward manifold 144 that are connected to the circulation pump 141, a filter 142, and a heat source are inserted in the outward flow path 132*a*, and the plurality of ink jet heads 120 are connected in a branching manner to the outward manifold 144. Similarly, a return manifold 146 is inserted in the return flow path 132*b*, and the plurality of ink jet heads 120 are connected in a converging manner to the return manifold 146.

The UV ink in the circulation flow path 132 is raised to a predetermined temperature by the heat exchanger 143, and is circulated by the circulation pump 141. That is, the viscosity of the UV ink is adjusted by the temperature rise, and is supplied to the ink jet heads 120 in this state. Specifically, the UV ink is adjusted to a viscosity of 8 mPas at 40° C., and is supplied to the plurality of ink jet heads 120 in a state where this viscosity (temperature) is maintained.

The circulation pump 141 is formed of the gear pump (1) that has low pressure fluctuations, and causes the UV ink to be supplied at a predetermined flow rate so that the UV ink supplied to the ink jet head 120 does not drop below 40° C. In so doing, the UV ink supplied to the ink jet head 120 has its viscosity suppressed to a predetermined value (8 mPas)

and the ink discharge amount from each discharge nozzle of the ink jet head 120 is stabilized.

Structure of Gear Pump

Next, the gear pump 1 that forms the circulation pump (141) will be described in detail with reference to FIGS. 3 to 6. Although, for the convenience of description, the upper side in the drawings is described as the upper side in the gear pump 1 in FIGS. 3 to 6 and the lower side in the drawings as the lower side in the gear pump 1, the arrangement directions of the actual gear pump 1 are not limited.

Figure 3:
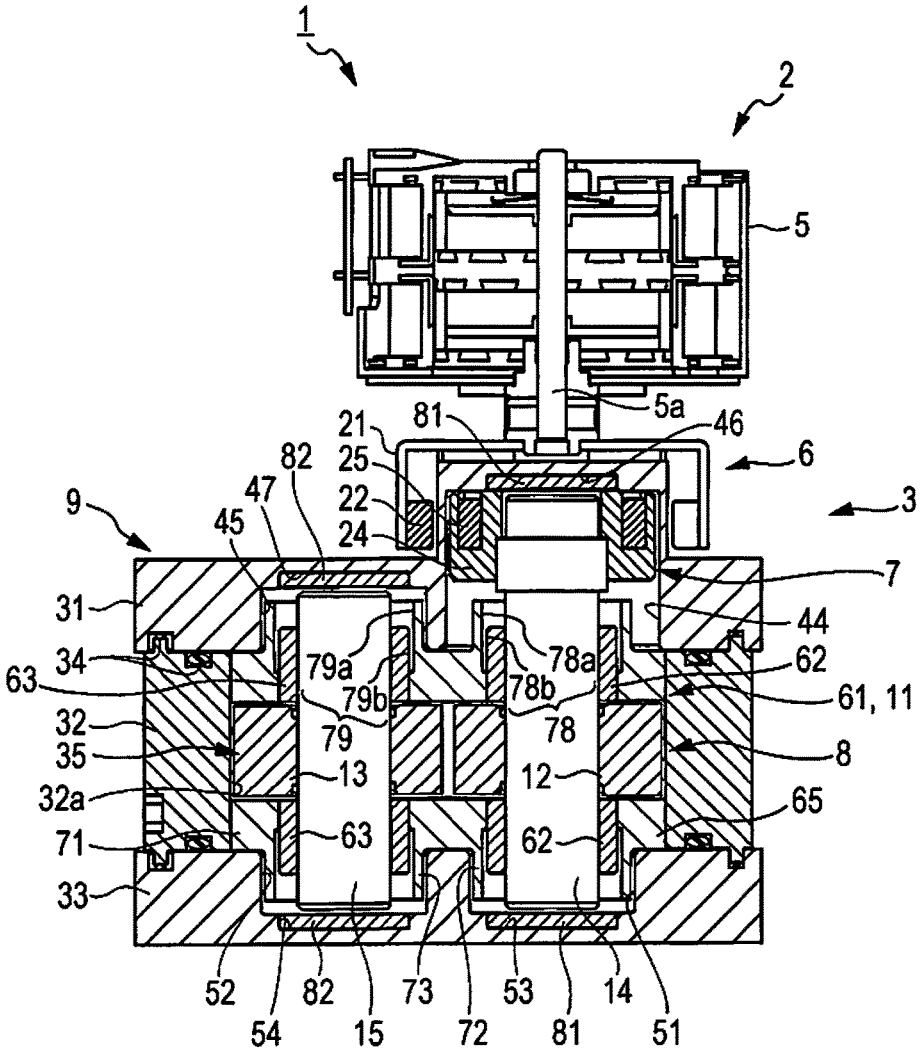
FIG. 3 is a cross-sectional view of a gear pump according to the embodiment.

As shown in FIGS. 3 and 4, the gear pump 1 is formed of a power unit 2 and a pump unit 3. The power unit 2 is provided with a motor 5 that is a power source and an output portion 6 that is linked to the main shaft 5*a* of the motor 5. The pump unit 3 is provided with an input portion 7 that corresponds to the output portion 6, a gear assembly 8 linked to the input portion 7, and a pump casing 9 with a divided structure in which the input portion 7 and the gear assembly 8 are accommodated. Although described in detail later, the gear assembly 8 is formed of incorporating the driving gear 12, the driven gear 13, the driving gear shaft 14 and the driven gear shaft 15 into a bearing frame 11.

The output portion 6 includes a cap-like output holder 21 linked to the main shaft 5*a* of the motor 5, and an outer magnet 22 provided on the inner circumferential surface of the output holder 21. Meanwhile, the input portion 7 includes a block-like input holder 24 fixed to the shaft end portion of the driving gear shaft 14 and an inner magnet 25 mounted so as to be embedded in the input holder 24. The output portion 6 (outer magnet 22) and the input portion 7 (inner magnet 25) form a so-called magnetic coupling, and the magnetic force of the outer magnet 22 that rotates due to the rotation of the motor 5 is received, and the inner magnet 25 rotates.

That is, the rotation power of the motor 5 is transmitted to the driving gear shaft 14 in a non-contact manner via the outer magnet 22 and the inner magnet 25. The input holder 24 is fixed by press-fitting or the like to the driving gear shaft 14. The outer magnet 22 and the inner magnet 25 are formed by a permanent magnet such as a neodymium magnet.

The pump casing 9 has, in order from the motor 5 side, an upper casing 31, an intermediate casing 32, and a lower casing 33, and these are bonded at the four corners thereof by screwing. The upper casing 31, the intermediate casing 32, and the lower casing 33 are bonded liquid-tight by an inner and outer double seal material 34 inserted between the end surfaces of one another. In so doing, a liquid-tight pump chamber 35 is formed in the pump casing 9.

Figure 4A:
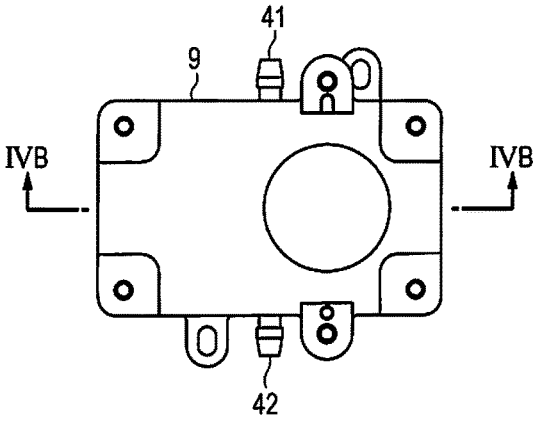
FIG. 4A is a plan view of a pump unit in the gear pump.
Figure 4C:
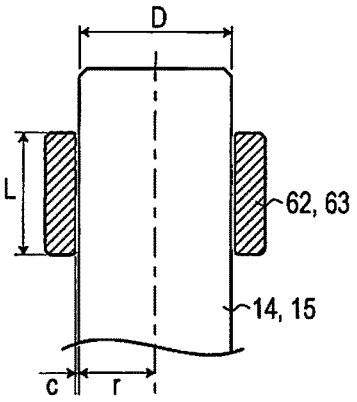
FIG. 4C is a diagram illustrating a dimensional and positional relationship between a driving gear shaft and a driving side bearing.

An intake port 41 is formed in one side surface of the intermediate casing 32, and a discharge port 42 is formed in the other side surface (refer to FIG. 4A). The intake port 41 and the discharge port 42 are formed in the shape of a coupling that is able to connect to a tube, and are provided so as to project from the side surfaces of the intermediate casing 32. Although it goes without saying, the circulation flow path 132 (tube) is connected to the intake port 41 and the discharge port 42.

The bearing frame 11 of the gear assembly 8 accommodated in the pump casing 9 is positioned on the inner circumferential surface 32*a* of the intermediate casing 32 (described in detail later). In this positioned state, the (tooth tips of) driving gear 12 and the driven gear 13 of the gear assembly 8 are opposite one another with a slight gap present on the inner circumferential surface 32*a* of the intermediate casing 32. When the driving gear 12 and the driven gear 13 rotate, the UV ink (viscous fluid) that flows in from the intake port 41 flows so that the flow is divided to substantially half flow into the slight gap, and the flows merge to flow out from the discharge port 42.

A circular driving side upper concave portion 44 in which the driving side convex portion 72 of the bearing frame 11, described later, is freely inserted and a circular driven side upper concave portion 45 in which a driven side convex portion 73 of the bearing frame 11, described later, is freely inserted are formed on the inner side of the upper casing 31. The outer side of the driving side upper concave portion 44 is projected in a circular shape, and the input portion 7 is accommodated in this part. A circular driving side upper shallow groove 46 is formed on the top surface of the driving side upper concave portion 44, and one driving side thrust bearing 81, described later, is mounted by press-fitting in the driving side upper shallow groove 46. Similarly, a circular driven side upper shallow groove 47 is formed on the top surface of the driven side upper concave portion 45, and one driven side thrust bearing 82, described later, is mounted by press-fitting or the like in the driven side upper shallow groove 47.

Similarly, a circular driving side lower concave portion 51 in which the driving side convex portion 72 of the bearing frame 11, described later, is freely inserted and a circular driven side lower concave portion 52 in which the driven side convex portion 73 of the bearing frame 11, described later, is freely inserted are formed on the inner side of the lower casing 33. In this case also, a circular driving side lower shallow groove 53 is formed on the bottom surface of the driving side lower concave portion 51, and the other driving side thrust bearing 81, described later, is mounted by press-fitting or the like in the driving side lower shallow groove 53. Similarly, a circular driven side lower shallow groove 54 is formed on the bottom surface of the driven side lower concave portion 52, and the other driven side thrust bearing 82, described later, is mounted by press-fitting or the like in the driven side lower shallow groove 54.

Structure of Gear Assembly

Figure 4B:
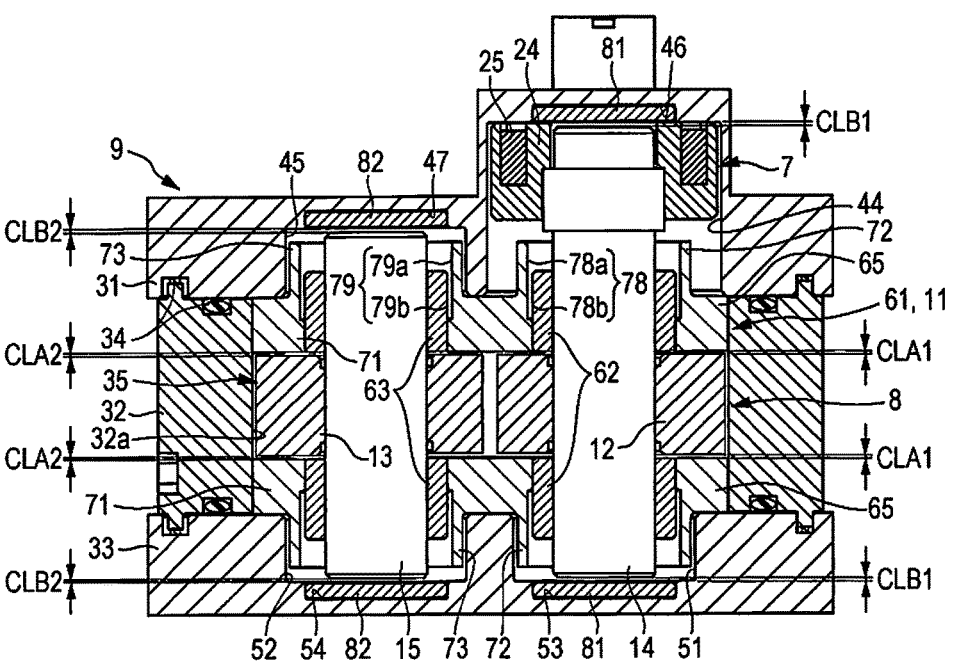
FIG. 4B is an enlarged cross-sectional view taken along line IVB-IVB in FIG. 4A.
Figure 5:
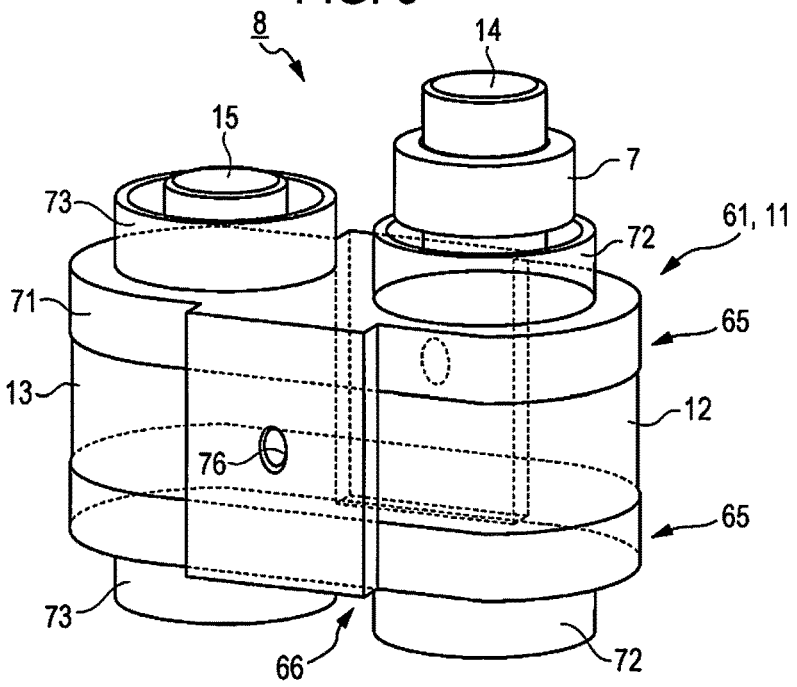
FIG. 5 is a perspective view of a gear assembly.
Figure 6:
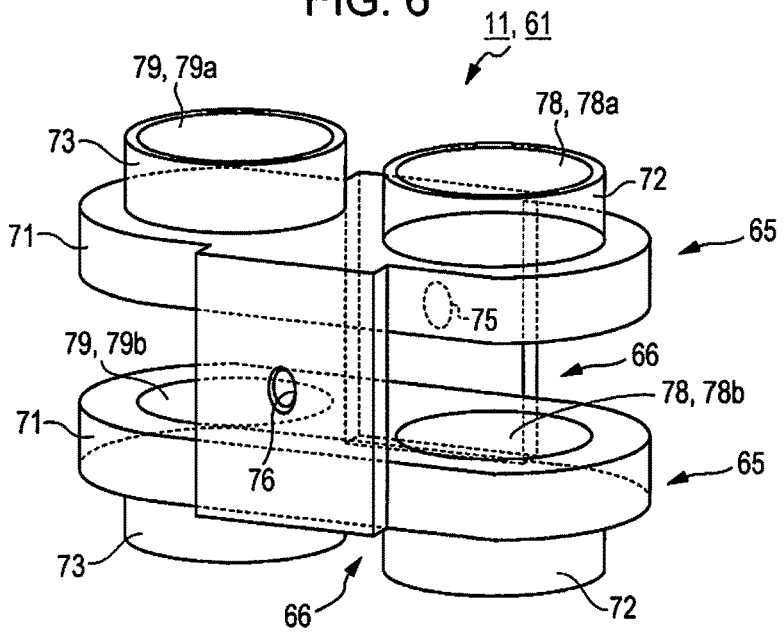
FIG. 6 is a perspective view of a bearing frame (frame main body).

As shown in FIGS. 4B, 5, and 6, the gear assembly 8 includes a driving gear 12, a driven gear 13 that meshes with the driving gear 12, a driving gear shaft 14 to which the driving gear 12 is attached, a driven gear shaft 15 to which the driven gear 13 is attached, and a bearing frame 11 that rotatably supports the driving gear shaft 14 and rotatably supports the driven gear shaft 15. The bearing frame 11 includes a frame main body 61, a pair of driving side bearings 62 (driving side bearing portion) and a pair of driven side bearings 63 (driving side bearing portion) built into the frame main body 61. Whereas the driving gear shaft 14 of the driving gear 12 is rotatably supported at both ends by the pair of driving side bearings 62, the driven gear shaft 15 of the driven gear 13 is rotatably supported at both ends by the pair of driven side bearings 63.

The frame main body 61 is integrally formed by a pair of bearing support portions 65 arranged so as to interpose the driving gear 12 and the driven gear 13 and a pair of connecting portions 66 that connect the pair of bearing support portions 65 on the outside (refer to FIG. 6). Each bearing support portion 65 includes an elliptical flange portion 71, and a circular driving side convex portion 72 and a circular driven side convex portion 73 that are provided so as to project from the flange portion 71.

The driving side convex portion 72 is arranged on the same axis as the driving gear shaft 14 (and the driving gear 12), and the semi-circular part of the driving gear 12 side of the flange portion 71 is arranged on the same axis as the driving gear shaft 14. Similarly, the driven side convex portion 73 is arranged on the same axis as the driven gear shaft 15 (and the driven gear 13), and the semi-circular part of the driven gear 13 side of the flange portion 71 is arranged on the same axis as the driven gear shaft 15. Both semi-circular parts of the flange portion 71 are formed with a slightly larger diameter than the driving gear 12 and the driven gear 13.

The driving side convexity 72 and the driven side convexity 73 in the upper side bearing support portion 65 are freely inserted in the driving side upper concavity 44 and the driven side upper concavity 45 of the upper casing 31 (refer to FIG. 4B). Similarly, the driving side convexity 72 and the driven side convexity 73 in the lower side bearing support portion 65 are freely inserted in the driving side lower concavity 51 and the driven side lower concavity 52 of the lower casing 33 (refer to FIG. 4B).

The pair of connecting portions 66 is integrally connected to the pair of flange portions 71, and the pair of flange portions 71 and the pair of connecting portions 66 come in contact (internal contact) with the inner circumferential surface 32*a* of the intermediate casing 32 (refer to FIG. 4B). That is, the gear assembly 8 is mounted so as to mate with the inner side of the pump casing 9. In so doing, the gear assembly 8 is immovably positioned in the pump casing 9.

An inflow port 75 connected to the intake port 41 of the pump casing 9 is formed in one connecting portion 66 that is formed in a rectangular shape and an outflow port 76 that connects to the discharge port 42 is formed in the other connecting portion 66 (refer to FIG. 6). The inflow port 75 and the outflow port 76 are formed in a circular shape with the same diameter as or a slightly larger diameter than the inner diameter of the intake port 41 and the discharge port 42.

A driving side shaft hole 78 in which the driving gear shaft 14 is freely inserted is formed in the inner side of each of the driving side convexity 72 and the flange portion 71. The driving side shaft hole 78 includes an upper side (front side) guide hole 78*a* and a lower side (rear side) fitting hole 78*b* that connects to the guide hole 78*a*, and the driving side bearing 62 is fixed so as to be press-fit to the fitting hole 78*b* (refer to FIG. 4B). That is, one driving side bearing 62 is fixed to the upper side fitting hole 78*b* and the other driving side bearing 62 is fixed to the lower side fitting hole 78*b*. The pair of driving side bearings 62 is arranged with a slight gap (gap in the axial direction) with respect to the driving gear 12. The driving gear shaft 14 is rotatably supported at both ends on the pair of driving side bearings 62.

Similarly, the driven side shaft hole 79 in which the driven gear shaft 15 is freely inserted is formed in the inner side of each of the driven side convexity 73 and the flange portion 71. Also in this case, the driven side shaft hole 79 includes an upper side (front side) guide hole 79*a* and a lower side (rear side) fitting hole 79*b* that connects to the guide hole 79*a*, and the driven side bearing 63 is fixed so as to be press-fit to the fitting hole 79*b* (refer to FIG. 4B). That is, one driven side bearing 63 is fixed to the upper side fitting hole 79*b* and the other driven side bearing 63 is fixed to the lower side fitting hole 79*b*. The pair of driven side bearings 63 is arranged with a slight gap (gap in the axial direction) with respect to the driven gear 13. The driven gear shaft 15 is rotatably supported at both ends on the pair of driven side bearings 63.

The driving gear 12 and the driven gear 13 are parts that exhibit a pumping action in the gear pump 1 and both are formed of spur gears. The driving gear 12 is fixed (attached) on the driving side bearing 62 by press-fitting. The driving gear 12 is arranged with a slight gap (clearance CLA1, described later) between the pair of bearing support portions 65. Similarly, the driven gear 13 is fixed (attached) to the driven side bearing 63 by press-fitting. The driven gear 13 is arranged with a slight gap (clearance CLA2, described later) between the pair of bearing support portions 65. The driving gear 12 and the driven gear 13 are formed of polyethylene terephthalate (PET) having chemical resistance and a suitable surface roughness.

The driving gear shaft 14 and the driven gear shaft 15 are configured with the same diameter, and the driving gear shaft 14 is formed longer than the driven gear shaft 15 by the amount attached to the input portion 7. The driving gear shaft 14 is rotatably supported by the pair of driving side bearings 62 in the radial direction in the vicinity of the driving gear 12 attached thereto. The driving gear shaft 14 is rotatably supported by the pair of driving side thrust bearings 81 at both shaft end surfaces thereof. Similarly, the driven gear shaft 15 is rotatably supported by the pair of driven side bearings 63 in the radial direction in the vicinity of the driven gear 13 attached thereto. The driven gear shaft 15 is rotatably supported by the pair of driven side thrust bearings 82 in the thrust direction at both shaft end surfaces thereof.

The driving side bearing 62 and the driven side bearing 63 are both formed in a cylindrical shape, and are formed of a journal bearing that receives a load in the radial direction. The driving side thrust bearing 81 and the driven side thrust bearing 82 are both formed in a disk shape, and formed with sufficiently larger diameter than the shaft diameter of the driving gear shaft 14 and the driven gear shaft 15. The driving gear shaft 14, the driven gear shaft 15, the driving side bearing 62, the driven side bearing 63, the driving side thrust bearing 81 and the driven side thrust bearing 82 are formed of an alumina ceramic having chemical resistance and a suitable surface roughness.

Incidentally, the UV ink (ultraviolet-curable ink) transported by the gear pump 1 of the embodiment has the characteristic of undergoing a polymerization reaction to be cured due to a temperature rise, in addition to irradiation of ultraviolet rays. In particular, in the UV ink that lubricates between the driving gear shaft 14 and the driving side bearing 62, between the driven gear shaft 15 and the driven side bearing 63, between the driving gear shaft 14 and the driving side thrust bearing 81, and between the driven gear shaft 15 and the driven side thrust bearing 82, there is concern of the UV ink undergoing a polymerization reaction and curing through excess heat generation (frictional heat) occurring due to the shaft and the bearing coming into contact, and the rotation of the driving gear shaft 14 or the driven gear shaft 15 locking (being unable to rotate) by the polymerization products generated through the curing.

In the embodiment, in addition to selecting the material so that fluid lubrication occurs between the driving gear shaft 14 and the driving side bearing 62, between the driven gear shaft 15 and the driven side bearing 63, between the driving gear shaft 14 and the driving side thrust bearing 81, and between the driven gear shaft 15 and the driven side thrust bearing 82 to prevent excess heat generation, the dimensional relationship of the various sliding (lubricated) parts such as between the driving gear shaft 14 and the driving side bearing 62, and between the driving gear shaft 14 and the driving side thrust bearing 81 is designed as follows.

That is, it is preferable that the width diameter ratio L/D that is the ratio of the bearing length L of the driving side bearing 62 (journal bearing) to the shaft diameter D of the driving gear shaft 14 is 0.5 to 2.0, and the ratio in the embodiment is designed to be width diameter ratio L/D=0.796. Similarly, it is preferable that the width diameter ratio L/D that is the ratio of the bearing length L of the driven side bearing 63 (journal bearing) to the shaft diameter D of the driven gear shaft 15 is 0.5 to 2.0, and the ratio in the embodiment is designed to be a width diameter ratio L/D=0.796.

It is preferable that the clearance ratio c/r that is the ratio of the clearance (radial clearance) c in the axial radial direction of the driving gear shaft 14 between the driving gear shaft 14 and the driving side bearing 62 (journal bearing) to the axial radius r of the driving gear shaft 14 is 0.0009 to 0.01, and the ratio in the embodiment is designed to be a clearance ratio c/r=0.005. Similarly, it is preferable that the clearance ratio c/r that is the ratio of the radial clearance c between the driven gear shaft 15 and the driven side bearing 63 (journal bearing) to the axial radius r of the driven gear shaft 15 is 0.0009 to 0.01, and the ratio in the embodiment is designed to be a clearance ratio c/r=0.005. It is preferable that the radial clearance c is 1.7 μm or more (for either, refer to FIG. 4C).

By designing the width diameter ratio L/D and the clearance ratio c/r in this way, fluid lubrication is created between the driving gear shaft 14 and the driving side bearing 62, and between the driven gear shaft 15 and the driven side bearing 63, and the generation of frictional heat is suppressed.

Additionally, it is preferable that the clearance CLA1 between the end surface of the driving gear 12 and the opposed surface of each bearing support portion 65 (flange portion 71) that opposes the end surface is 50 μm or more, and the clearance in the embodiment is designed to be a clearance CLA1=100 μm. Similarly, it is preferable that the clearance CLA2 between the end surface of the driven gear 13 and the opposed surface of each bearing support portion 65 (flange portion 71) that opposes the end surface is 50 μm or more, and the clearance in the embodiment is designed to be clearance CLA2=100 μm (for either, refer to FIG. 4B).

It is preferable that the clearance CLB1 between the shaft end surface of the driving gear shaft 14 and the thrust bearing surface of the driving side thrust bearing 81 is 1.7 μm or more to 2500 μm or less, and the clearance in the embodiment is designed to be a clearance CLB1=50 μm. Similarly, it is preferable that the clearance CLB2 between the shaft end surface of the driven gear shaft 15 and the thrust bearing surface of the driven side thrust bearing 82 is 1.7 μm or more to 2500 μm or less, and the clearance in the embodiment is designed to be a clearance CLB2=50 μm (for either, refer to FIG. 4B).

By being designed in this way, fluid lubrication is created between the driving gear shaft 14 and the driving side thrust bearing 81, and between the driven gear shaft 15 and the driven side thrust bearing 82, and the generation of frictional heat is suppressed.

Action and Effects

As above, according to the gear pump 1 of the embodiment, component parts are assembled so that the driving gear 12, the driven gear 13, the driving gear shaft 14, and the driven gear shaft 15 are assembled to the bearing frame 11 (frame main body 61), and the pair of driving side bearings 62 and the pair of driven side bearings 63 are assembled to the bearing frame 11 (frame main body 61). Therefore, the pair of driving side bearings 62 can be arranged on the same axis with high accuracy, and the pair of driven side bearings 63 can be arranged on the same axis with high accuracy. In addition, the pair of driving side bearings 62 and the pair of driven side bearings 63 can be arranged with high accuracy so that the axis line of the pair of driving side bearings 62 and the axis line of the pair of driven side bearings 63 become parallel to each other.

Accordingly, the driving gear shaft 14 (driven gear shaft 15) can be supported by the pair of driving side bearings 62 (driven side bearings 63) with an appropriate clearance. The portion can be appropriately lubricated by the UV ink. Accordingly, heat generation from the sliding parts (lubricated parts) between the driving gear shaft 14 (driven gear shaft 15) and the driving side bearing 62 (driven side bearing 63) is suppressed, and curing of the UV ink that functions as a lubricating oil is prevented.

Furthermore, because a sufficient clearance is held between the end surface of the driving gear 12 (driven gear 13) and the opposing surface of each bearing support portion 65, and between the shaft end surface of the driving gear shaft 14 (driven gear shaft 15) and the thrust bearing surface of the driving side thrust bearing 81 (driven side thrust bearing 82) that are the sliding parts (lubricated parts) between the members, it is possible for heat generation due to members coming in contact with each other to be suppressed, and to prevent curing of the UV ink that functions as a lubricating oil in these parts. In this way, because it is possible to prevent curing of the UV ink in each of the sliding parts (lubricated parts) of the gear pump 1, it is possible to effectively prevent rotation locking of the gear pump 1.

In the embodiment, although the driving side bearing 62 and the driven side bearing 63 are formed separate to the frame main body 61, these members may be formed integrally to the frame main body 61. That is, the pair of driving side bearing portions and the pair of driven side bearing portions may be formed in the bearing frame 11. In addition, the gear assembly 8 of the invention can be applied to a general gear pump which uses a hydraulic oil as a transport target.

The entire disclosure of Japanese Patent Application No. 2015-084841, filed Apr. 17, 2015 is expressly incorporated by reference herein.

According to an aspect of the invention, there is provided a gear pump for transporting a fluid including a pump casing; and a gear assembly which is accommodated in the pump casing, in which the gear assembly includes a driving gear, a driven gear that meshes with the driving gear, a driving gear shaft to which the driving gear is attached, a driven gear shaft to which the driven gear is attached, and a bearing frame that rotatably supports the driving gear shaft and rotatably supports the driven gear shaft.

According to the configuration, the gear assembly which is accommodated in the pump casing includes the bearing frame which supports the driving gear shaft and the driven gear shaft. That is, the driving gear shaft and the driven gear shaft are not supported in the pump casing and are supported by the bearing frame which is accommodated in the pump casing. In this case, the bearing frame is different from the pump casing, and the bearing part can be formed with high accuracy without considering the water-tightness or a clearance between blade edges of the driving gear and the driven gear (it is not required to configure a pump chamber). Specifically, the bearing part with respect to the driving gear shaft and the bearing part with respect to the driven gear shaft can be formed with high accuracy, and the bearings can be formed in parallel with each other with high accuracy. Accordingly, the clearance between the driving gear shaft and the bearing part thereof and the clearance between the driven gear shaft and the bearing part thereof can be formed with high accuracy, and it is possible to effectively prevent heat generated from the bearing part.

The driving gear, the driven gear, the driving gear shaft, and the driven gear shaft are assembled with each other by the bearing frame, thereby it is possible to improve the assemblability and maintenance. In particular, in the maintenance, the gear assembly can be replaced as a united body.

In this case, it is preferable that the bearing frame includes a frame main body, a pair of driving side bearing portions which is provided in the frame main body and which supports the driving gear shaft at both ends thereof, and a pair of driven side bearing portions which is provided in the frame main body and which supports the driven gear shaft at both ends thereof.

In this case, it is preferable that the frame main body is integrally formed by a pair of bearing support portions, in which the driving side bearing portion and the driven side bearing portion are provided, and a pair of connecting portions which connect the pair of bearing support portions.

According to the configuration, since the pair of bearing support portions and the pair of connecting portions are integrally formed, the pair of driving side bearing portions supporting the driving gear shaft and the pair of driven side bearing portions supporting the driven gear shaft can be formed in the pair of bearing support portions with high accuracy, respectively, and the pair of bearings can be mutually formed with high accuracy. In addition, the driving side bearing portion and the driven side bearing portion may be integrally formed with the bearing support portion (frame main body), and may be separately formed from the bearing support portion.

It is preferable that each of the driving side bearing portions and the driven side bearing portion is formed of a journal bearing which is separate from the frame main body.

According to the configuration, the materials of the driving side bearing portion and the driven side bearing portion is selected in consideration of the bearing precision, but the material of the frame main body is selected without considering the bearing precision. Therefore, a whole gear assembly can be formed at low costs.

In this case, it is preferable that, each of the driving gear shaft, the driven gear shaft, the driving side bearing portion, and the driven side bearing portion is formed of an alumina ceramic.

According to the configuration, the gear assembly can be formed in consideration of the chemical resistance. The surface roughness of the mutual lubrication surfaces (boundary surfaces) of the driving gear shaft (driven gear shaft) and the driving side bearing portion (driven side bearing portion) can be made suitable (low). Accordingly, the clearance between the driving gear shaft (driven gear shaft) and the driving side bearing portion (driven side bearing portion) can be suitably held by the dynamic pressure and the generation of frictional heat can be suppressed.

It is preferable that a clearance between an end surface of the driving gear and an opposed surface of each bearing support portion that opposes the end surface is 50 μm or more, and a clearance between an end surface of the driven gear and an opposed surface of each bearing support portion that opposes the end surface is 50 μm or more.

According to the configuration, even if the parallelism between the end surface of the driving gear (driven gear) and the opposed surface of the bearing support portion is insufficient, both can be prevented from coming in direct contact. An appropriate lubricating film (boundary film) can be formed due to the dynamic pressure between the end surface of the driving gear (driven gear) and the opposed surface of the bearing support portion. Accordingly, heat generation from these parts can be suppressed.

In this case, it is preferable that each of the driving gear and the driven gear is formed of polyethylene terephthalate.

According to the configuration, the driving gear and the driven gear can be provided with the chemical resistance without impairing the performance of the gear. In addition, the surface roughness of the mutual lubrication surfaces (sliding surfaces) of the opposed surfaces of the driving gear (driven gear) and the bearing support portion can be made suitable. Accordingly, heat generation from these parts can be suppressed.

It is preferable that each of the connecting portions is formed in a plate shape, and includes an inflow port that connects to an intake port of the pump casing and an outflow port that connects to a discharge port of the pump casing.

According to the configuration, a fluid to be sucked into the pump casing can be allowed to flow to the driving gear and the driven gear via the inflow port from the intake port, and a fluid extracted by the driving gear and the driven gear can be allowed to flow to the discharging port thought the outflow port. Accordingly, a pumping action by the driving gear and the driven gear is not inhibited by the pair of connecting portions.

It is preferable that the fluid is an ultraviolet curable ink.

The ultraviolet-curable ink has the characteristic of easily undergoing a polymerization reaction due to heat.

According to the configuration, since excess heat generation is prevented, and curing of the ultraviolet-curable ink due to heat can be prevented, the driving gear shaft and the driven gear shaft can be prevented from becoming fixed to the bearing parts. In so doing, transport of the ultraviolet-curable ink can be stably performed.

According to still another aspect of the invention, there is provided a printing apparatus, including a print head that performs printing by discharging an ultraviolet-curable ink to a printing medium; a circulation flow path that supplies the ultraviolet-curable ink to the print head; and a circulation pump inserted in the circulation flow path, in which the circulation pump is the above-described gear pump according.

According to the configuration, because transport of the ultraviolet-curable ink can be stably performed with the circulation pump, printing on the printing medium can be stably performed by the print head. The maintenance frequency of the gear pump (circulation pump) can be extremely suppressed.

What is claimed is:

1. A gear pump for transporting a fluid comprising:

a pump casing; and a gear assembly which is accommodated in the pump casing, the gear assembly including a driving gear, a driven gear that meshes with the driving gear, a driving gear shaft to which the driving gear is attached, a driven gear shaft to which the driven gear is attached, and a bearing frame that rotatably supports the driving gear shaft and rotatably supports the driven gear shaft, the bearing frame including a frame main body, first and second driving side bearing portions which are provided in the frame main body and which support the driving gear shaft, and first and second driven side bearing portions which are provided in the frame main body and which support the driven gear shaft, the frame main body having first and second bearing support portions which are disposed away from each other in an axial direction of the driving gear shaft and a connecting portion which connects the first and second bearing support portions with respect to each other, the first driving side bearing portion and the first driven side bearing portion being provided in the first bearing support portion, the second driving side bearing portion and the second driven side bearing portion being provided in the second bearing support portion, the first and second bearing support portions and the connecting portion being integrally formed as a one-piece member.

2. The gear pump according to claim 1, wherein each of the first and second driving side bearing portions and the first and second driven side bearing portions is formed of a journal bearing which is separate from the frame main body.

3. The gear pump according to claim 2, wherein each of the driving gear shaft, the driven gear shaft, the first and second driving side bearing portions, and the first and second driven side bearing portions is formed of an alumina ceramic.

4. The gear pump according to claim 1, wherein a clearance between an end surface of the driving gear and an opposed surface of corresponding one of the first and second bearing support portions that opposes the end surface is 50 μm or more, and wherein a clearance between an end surface of the driven gear and an opposed surface of corresponding one of the first and second bearing support portions that opposes the end surface is 50 μm or more.

5. The gear pump according to claim 4, wherein each of the driving gear and the driven gear is formed of polyethylene terephthalate.

6. The gear pump according to claim 1, wherein the connecting portion is formed in a plate shape, and includes an inflow port that connects to an intake port of the pump casing and an outflow port that connects to a discharge port of the pump casing.

7. The gear pump according to claim 1, wherein the fluid is an ultraviolet-curable ink.

8. A printing apparatus comprising:

a print head that performs printing by discharging an ultraviolet-curable ink to a printing medium;

a circulation flow path that supplies the ultraviolet-curable ink to the print head; and a circulation pump inserted in the circulation flow path, wherein the circulation pump is formed of the gear pump according to claim 7.

9. The gear pump according to claim 1, wherein the first and second driving side bearing portions support the driving gear shaft at both ends thereof.

10. The gear pump according to claim 1, wherein the first and second driven side bearing portions support the driven gear shaft at both ends thereof.

11. The gear pump according to claim 1, wherein each of the first and second driving side bearing portions and the first and second driven side bearing portions is a separate member from the frame main body, the first and second driving side bearing portions being disposed between the driving gear shaft and the frame main body, the first and second driven side bearing portions being disposed between the driven gear shaft and the frame main body.

12. The gear pump according to claim 1, wherein the connecting portion extends between the first and second bearing support portions.

13. The gear pump according to claim 1, wherein the connecting portion includes connecting parts that are opposite to each other in a direction perpendicular to the axial direction of the driving gear shaft and at least partially sandwich the driving gear and the driven gear therebetween, one of the connecting parts having an inflow port for the fluid, the other one of the connecting parts having an outflow port for the fluid.

14. A manufacturing method for a gear pump for transporting a fluid comprising:

providing a pump casing; and providing a gear assembly in the pump casing, the gear assembly including a driving gear, a driven gear that meshes with the driving gear, a driving gear shaft to which the driving gear is attached, a driven gear shaft to which the driven gear is attached, and a bearing frame that rotatably supports the driving gear shaft and rotatably supports the driven gear shaft, the bearing frame including a frame main body, first and second driving side bearing portions which are provided in the frame main body and which support the driving gear shaft, and first and second driven side bearing portions which are provided in the frame main body and which support the driven gear shaft, the frame main body having first and second bearing support portions which are disposed away from each other in an axial direction of the driving gear shaft and a connecting portion which connects the first and second bearing support portions with respect to each other, the first driving side bearing portion and the first driven side bearing portion being provided in the first bearing support portion, the second driving side bearing portion and the second driven side bearing portion being provided in the second bearing support portion, the providing of the gear assembly including integrally forming the first and second bearing support portions and the connecting portion as a one-piece member.

15. A gear pump for transporting a fluid comprising:

a pump casing; and a gear assembly which is accommodated in the pump casing, the gear assembly including a driving gear, a driven gear that meshes with the driving gear, a driving gear shaft to which the driving gear is attached, a driven gear shaft to which the driven gear is attached, and a bearing frame that rotatably supports the driving gear shaft and rotatably supports the driven gear shaft, the bearing frame including a frame main body, a pair of driving side bearing portions which is provided in the frame main body and which supports the driving gear shaft, and a pair of driven side bearing portions which is provided in the frame main body and which supports the driven gear shaft, the frame main body having a pair of bearing support portions, in which the driving side bearing portion and the driven side bearing portion are provided, and a connecting portion which connects the bearing support portions, the bearing support portions and the connecting portion being integrally formed as a one-piece member, each of the driving gear shaft, the driven gear shaft, the driving side bearing portion, and the driven side bearing portion is formed of an alumina ceramic.

* * * * *